US010982921B2

(12) United States Patent
Karagias

(10) Patent No.: US 10,982,921 B2
(45) Date of Patent: Apr. 20, 2021

(54) FIREARM BARREL PRE-LOADING DEVICES, CONNECTION ASSEMBLIES, AND FIREARMS

(71) Applicant: Theodore Karagias, Seattle, WA (US)

(72) Inventor: Theodore Karagias, Seattle, WA (US)

( * ) Notice: Subject to any disclaimer, the term of this patent is extended or adjusted under 35 U.S.C. 154(b) by 0 days.

(21) Appl. No.: 16/134,908

(22) Filed: Sep. 18, 2018

(65) Prior Publication Data

US 2019/0086175 A1 Mar. 21, 2019

Related U.S. Application Data

(60) Provisional application No. 62/729,924, filed on Sep. 11, 2018, provisional application No. 62/564,968, filed on Sep. 28, 2017, provisional application No. 62/560,103, filed on Sep. 18, 2017.

(51) Int. Cl.
*F41A 21/48* (2006.01)

(52) U.S. Cl.
CPC ..... *F41A 21/48* (2013.01); *F41A 21/482* (2013.01)

(58) Field of Classification Search
CPC ..... F41A 21/48; F41A 21/482; F41A 21/481; F41A 21/487
See application file for complete search history.

(56) References Cited

U.S. PATENT DOCUMENTS

| | | | | |
|---|---|---|---|---|
| 6,694,660 | B1 * | 2/2004 | Davies | F41A 21/482 42/71.01 |
| 7,743,543 | B2 | 6/2010 | Karagias | |
| 8,171,666 | B2 | 5/2012 | Karagias | |
| 8,572,885 | B2 | 11/2013 | Karagias | |
| 9,097,478 | B1 | 8/2015 | Karagias | |
| 9,377,255 | B2 | 6/2016 | Karagias | |
| 9,574,834 | B2 | 2/2017 | Karagias | |
| 10,082,356 | B2 | 9/2018 | Karagias | |
| 10,458,733 | B2 | 10/2019 | Karagias | |
| 2007/0079539 | A1 | 4/2007 | Karagias | |
| 2007/0245615 | A1 | 10/2007 | Karagias | |
| 2011/0023348 | A1 | 2/2011 | Karagias | |
| 2011/0030261 | A1 | 2/2011 | Karagias | |
| 2011/0271578 | A1 | 11/2011 | Karagias | |
| 2012/0131835 | A1 * | 5/2012 | Barrett | F41A 21/481 42/75.02 |
| 2015/0233656 | A1 | 8/2015 | Karagias | |
| 2016/0025434 | A1 | 1/2016 | Karagias | |
| 2017/0010064 | A1 | 1/2017 | Karagias | |
| 2017/0350664 | A1 | 12/2017 | Karagias | |
| 2019/0086175 | A1 | 3/2019 | Karagias | |
| 2020/0263942 | A1 | 8/2020 | Karagias | |

* cited by examiner

*Primary Examiner* — J. Woodrow Eldred
(74) *Attorney, Agent, or Firm* — Perkins Coie LLP

(57) ABSTRACT

A firearm barrel preloading device can preload threaded connections. The preloading device can include an outwardly facing barrel-contact surface, an outwardly facing receiver-contact surface, non-planar surfaces between the barrel-contact surface and the receiver-contact surface. The non-planar surfaces can include mated pairs of axisymmetric surfaces that cooperate to spread apart the barrel-contact surface and the receiver-contact surface when the preloading device is moved toward an expanded configuration.

14 Claims, 14 Drawing Sheets

FIREARM BARREL PRE-LOADING DEVICES, CONNECTION ASSEMBLIES, AND FIREARMS

RELATED APPLICATIONS

The present application claims the benefit of U.S. Provisional Patent Application No. 62/560,103, filed Sep. 18, 2017, U.S. Provisional Patent Application No. 62/564,968, filed Sep. 28, 2017, and U.S. Provisional Application No. 62/729,924, filed Sep. 11, 2018, the disclosures of which are incorporated herein by reference in their entireties.

TECHNICAL FIELD

The present invention relates generally to firearms and components for firearms. More specifically, the invention relates to firearms, barrel preloaders, connection assemblies, and related technologies.

BACKGROUND

Conventional firearms often have interchangeable barrels for using different caliber ammunition. To install a barrel, a threaded end of a barrel can be threadably connected to a receiver. Significant forces need to be applied to the barrel to prevent motion between the barrel and the receiver that could adversely affect accuracy. For example, threaded receiver-barrel connections can often require preloading of approximately 100 pound-feet of torque. Barrel nuts can also be used to preload receiver-barrel connections. Unfortunately, specialized tools (e.g., barrel nut wrenches, clamps, etc.) are needed to remove barrels and then securely install another barrel in the receiver without damaging either the barrel or receiver. Additionally, some conventional barrel installations require drilling holes into the face of a receiver.

DETAILED DESCRIPTION

Figure 1:
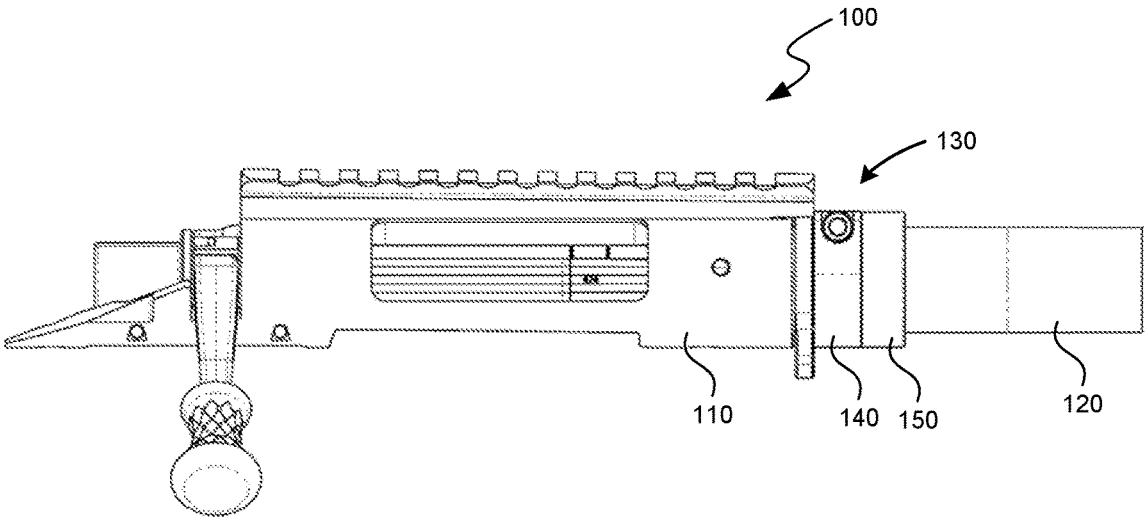
FIG. 1 is a side view of a portion of a firearm with a barrel connection assembly in accordance with one embodiment.

The present technology is generally directed to firearms, preloaders, connection assemblies, and methods of using the same. Specific details and embodiments of the technology are described below with reference to FIGS. 1-44. The technology can be used for interchanging barrels to use different caliber ammunition. Barrels can be quickly and conveniently replaced in the field using common tools, such as a hex key. To install a barrel, an end of the barrel can be threadably connected to an action. A preloading device can then preload the threaded connection, thereby securing the barrel to the action without damaging the barrel and/or action. A person of ordinary skill in the art will understand that the technology can have other embodiments and additional elements and features, used with different types of firearms, or the technology can have other embodiments without several of the features shown and described below with reference to FIGS. 1-44.

Overview

In some example embodiments, a barrel thread locking device can include a tensioner and a barrel nut. The tensioner can include one or more split collars or nuts. The barrel nut can have a sloped surface for contacting a surface of the tensioner. The tensioner can be operated to adjust the force applied to the barrel nut. For example, the tensioner can push the barrel nut away from the receiver, thereby tensioning the end portion of the barrel. The locking device can include a recoil lug for bearing against the receiver, stock, or another feature of the firearm. In some embodiments, the tensioner is a split collar or nut with at least one recoil lug. Other features can be used to manage forces. For example, plates, spacers, or other features can help manage forces applied to connections. The barrel thread locking device can be a preloading device capable of controllable expansion for preloading threaded connections, thereby producing forces sufficient to prevent motion between the barrel and the receiver to avoid adversely affecting accuracy. Non-specialized tools can be used to controllably adjust the preloading without damaging either the barrel or receiver.

In further embodiments, a preloading device includes a split collar and washers. The split collar can have a main body that wedges apart the washers when the split collar is contracted or collapsed. The split collar can be closed to wedge apart the washers, which in turn press against the receiver and barrel. For example, partially conical or frustaconical surfaces of the washers can contact toroidal wedge-shaped portions of the main body.

In yet further embodiments, a barrel tensioning assembly includes a split collar and a barrel nut. The split collar and barrel nut are configured to operate to tension the barrel or other components. The barrel tensioning assembly can be a preloading device.

In yet other embodiments, a preloading device has non-planar surfaces for contacting or otherwise engaging one another to generate forces. The preloading device can include a split collar having non-planar surfaces for engaging non-planar surfaces of washers. The split collar can maintain contact with corresponding non-planar washer surfaces regardless of alignment of the barrel with respect to the receiver when the barrel is installed and at a ready to fire position. This can ensure that the barrel properly bears against the preloading device even when the barrel is misaligned with respect to the preloading device. In some embodiments, one non-planar surface of the split collar is coincident with a first single imaginary non-planer axisymmetric washer, and another non-planar surface of the split collar is coincident with a second single imaginary non-planar axisymmetric surface of the other washer. The first and second single imaginary non-planer axisymmetric surfaces can be, for example, partially spherical shaped, conical shaped, parabolic, and/or toroidal shaped. In other embodiments, the split collar can contact non-planar surfaces of recoil lugs, nuts (e.g., barrel nuts), or the like.

In some embodiments, a preloading device includes a countersunk split ring. One or both sides of the split ring can be countersunk to receive an adjacent component, such as a washer or a barrel nut. In certain embodiments, the split ring can be countersunk to slidably contact a non-planar surface, such as a partially toroidal surface, a partially conical surface, or the like, of the washer or barrel nut. In some embodiments, opposing sides of the split ring can be countersunk for receiving and slidably contacting components positioned on opposite sides of the split ring.

In yet further embodiments, a preloaded device includes a linearly expandable drive assembly. The drive assembly can include one or more spreaders that wedge apart washers or other elements, such as barrel nuts, lugs etc. One or more screws can be used to expand and collapse the drive assembly. The spreaders can have tapered edges or ends that slidably engaged sloped surfaces of the washers. The spreaders can translate in directions that are substantially perpendicular a midsagittal plane of the firearm and/or barrel. For example, the spreaders can translate linearly toward a vertical plane passing through the longitudinal axis of the barrel in order to push the washers in a direction that is substantially parallel to the longitudinal axis. The movement of the spreaders can be selected based on the desired rate and amount of expansion.

In yet further embodiments, a firearm includes a receiver, a barrel, and a locking or preloading device. The locking or preloading device can include one or more connection assemblies. The tensioning assemblies can include one or more locking devices, preloaders, tensioners, fasteners, alignment features (e.g., pins), force distributors (e.g., recoil lugs), or the like.

In some embodiments, a firearm barrel preloading device includes an outwardly facing barrel-contact surface, an outwardly facing receiver-contact surface, and axisymmetric surfaces. The axisymmetric surfaces are located between the barrel-contact surface and the receiver-contact surface. The axisymmetric surfaces can cooperate to spread apart the barrel-contact surface and the receiver-contact surface when the firearm barrel preloading device is moved toward an expanded configuration.

A method for tensioning at least a portion of a barrel can include threadably coupling a barrel nut to a barrel. The barrel is threadably connected to a firearm receiver. The configuration of a tension control element is adjusted to adjust tensioning of a portion of the barrel between the barrel nut and the receiver, preloading of threaded connections, or combinations thereof.

Firearm Barrel Preloaders and Connection Assemblies

FIG. 1 is a side view of a portion of a firearm 100 in accordance with one embodiment. The firearm 100 can include a receiver 110, a barrel 120, and a connection or tensioner assembly 130 ("connection assembly 130"). The connection assembly 130 can include a tensioning element or split collar 140 ("split collar 140") and a barrel nut 150. The split collar 140 can be operated to adjusted applied desired forces and/or pressures to threaded connections. A threaded end of the barrel 120 is received in a threaded end of the receiver 110. The split collar 140 is positioned generally between an end of the receiver and the barrel nut 150. The split collar 140 can be expanded and contracted to cause the barrel nut 150 to apply a desired amount of force to the barrel 120, thereby tensioning the barrel 120. For example, the split collar 140 can be radially contracted to push the barrel nut 150 away from the receiver 110. The connection assembly 130 can function as a preloading device and can be used with a wide range of different type of barrels and actions.

Figure 2:
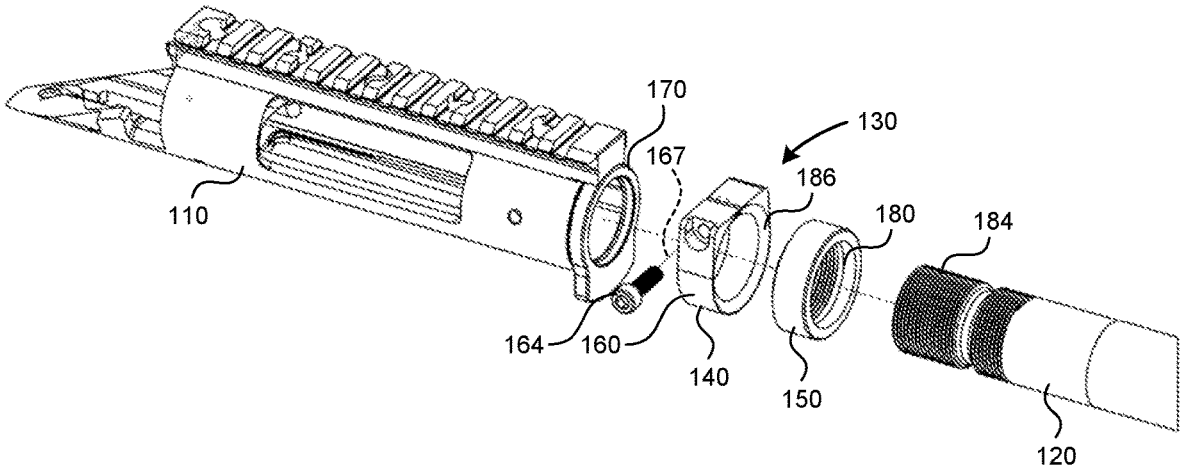
FIG. 2 is an exploded isometric view of the portion of the firearm of FIG. 1.
Figure 3:
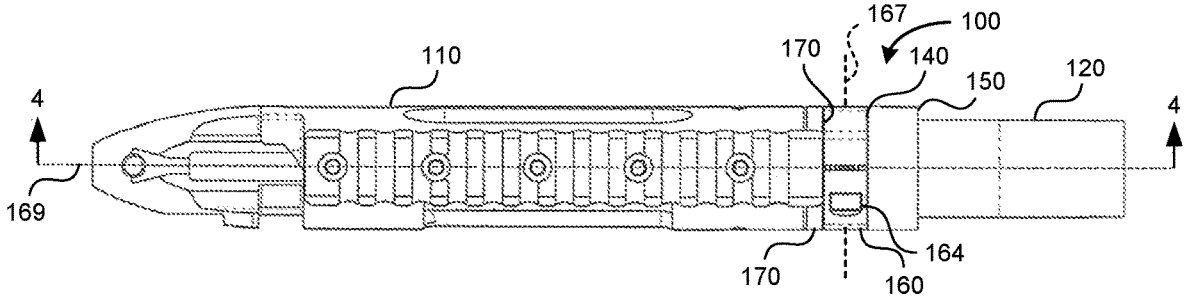
FIG. 3 is a top plan view of a portion of the firearm in accordance with one embodiment.

FIG. 2 is an exploded isometric view of the connection assembly 130 in accordance with an embodiment of the technology. FIG. 3 is a top plan view of components of the firearm. In general, the split collar 140 can open and close without contacting the barrel 120 and/or marring the outer surfaces of the receiver 110 and/or barrel 120. Axisymmetric surfaces of the connection assembly 130 can slidably contact one another such that the connection assembly 130 pushes the barrel 120 without imparting substantial moments to adjacent components, such as the receiver, barrel, recoil components (e.g., recoil lugs). The connection assembly 130 can automatically align itself with adjacent components for convenient assembly and for maintaining alignment.

The split collar 140 can include a main body 160 and the fastener 164 (illustrated as a screw). Encircling the bore (hole) of the split collar 140 is a shallow curved (e.g., conical) seat 186 against which a conical, spherical, toroidal, or otherwise axisymmetrical feature (e.g., non-planar surface) of the nut 150 will come to bear. The split collar 140 can have a one-piece or multi-piece body 160 and can include alignment features (e.g., protrusions, pins, etc.), force distributors, holes for receiving fasteners, or the like.

A fastener 164 can impart an axial force along a line of action 167 that is generally perpendicular to a sagittal plane 169 (FIG. 3) of the receiver 110 and/or connection assembly 130. The fastener 164 can then be tightened and thus effectively preload the barrel thread thereby immobilizing the receiver 110 and the barrel 120 with respect to one another.

To install the barrel 120, the nut 150 is moved onto the barrel threads of a threaded portion 184 of the barrel 120 as far as possible ensuring that the conical (or more generally, axisymmetrical) seat of the nut is facing the receiver 110. The nut 150 can include a threaded section 180 configured to threadably engage the threaded portion 184 of the barrel 120. The split collar 140 is moved over the barrel threads so that the cone (countersink) is facing the nut 150. The barrel 120 is screwed into the receiver 110 until it comes to stop against a gage while the split collar 140 lays flat against an end 170 of the receiver 110. Ensuring the fastener 164 is loose, the nut is turned back toward the receiver so as to firmly sandwich the split collar 140 between the receiver 110 and the nut 150. This may cause the split collar 140 to open by a small amount. The screw 164 can be tightened to controllably preload the barrel-receiver joint a desired amount, thus completing the assembly process.

One advantage of at least some embodiments over conventional connections is that they do not require drilling holes into the face of a receiver (e.g., preloading devices can apply preloads without being mechanically connected to the receiver). The split collar 140 and nut 150 can slidably contact one another to inhibit or prevent appreciable forces, moments, or pressures that could cause deformation of the receiver 110 and/or barrel 110 and/or to maintain face-to-face contact with the receiver. The collapsing action of the split collar forces the barrel 120 and the receiver 110 in opposing directions with significant mechanical advantage for significant preloading, tensioning, etc. Threads can be preloaded for multiple reasons, including the preservation of the positional relationship between the barrel 120 and receiver/scope. The fastener 164 can be used to open the split ring 140 to replace the barrel 120 with another barrel.

Figure 4:
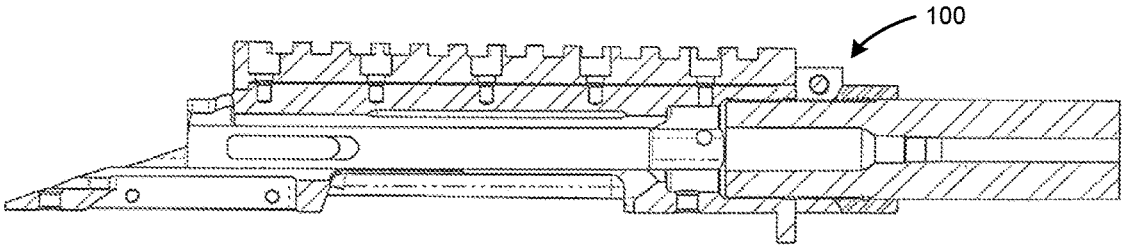
FIG. 4 is a cross-sectional view of the portion of the firearm taken along line 4-4 of FIG. 3.
Figure 5:
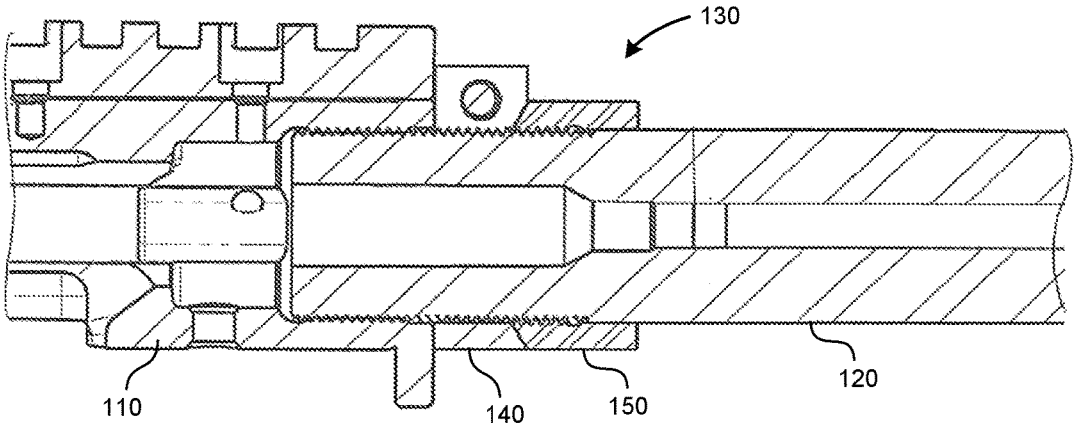
FIG. 5 is a detailed cross-sectional view of a barrel connection assembly.

FIG. 3 is a top plan view of the portion of the firearm in accordance with one embodiment. FIG. 4 is a cross-sectional view of the portion of the firearm taken along line 4-4 of FIG. 3. FIG. 5 is a detailed view of the barrel connection assembly 130. Referring now to FIG. 5, the threaded end of the barrel 120 is received in the threaded end of the receiver 110. The split collar 140 is positioned generally between an end of the receiver 110 and the barrel nut 120. The split collar 140 can be opened and closed to cause the barrel nut 150 to apply a desired amount of force to threads (e.g., receiver threads, barrel threads, etc.) for tensioning a section of the barrel 120. For example, the split collar 140 can be moved toward a closed configuration or open configuration to increase or decrease, respectively, the force/pressure applied to the barrel nut 150. The split collar 140 can surround and be spaced apart from the tensioned section of the barrel 120.

The split collar 140 can be opened to allow disassembly without damaging or altering the receiver 110. In some embodiments, the connection assembly 130 is an aftermarket product that can be used to install different types of barrels. The interface between the split collar and the barrel nut can be selected based on the desired forces to be applied. For example, the slope of the face of the barrel nut can be selected to achieve the desired tensioning upon operation of the split collar.

Figure 6:
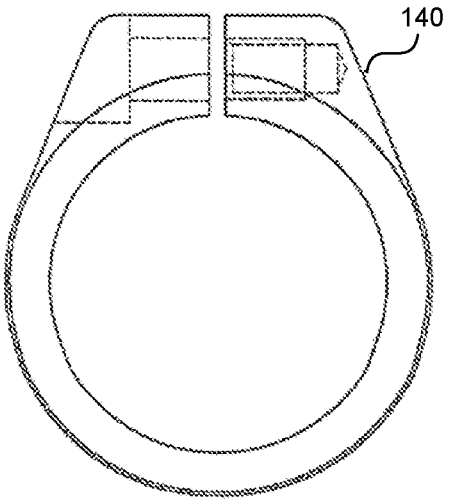
FIG. 6 is a front view of a split collar in accordance with one embodiment.
Figure 7:
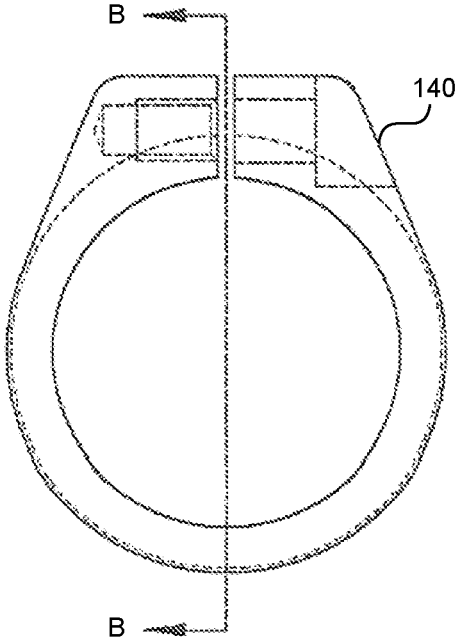
FIG. 7 is a back view of the split collar.
Figure 8:
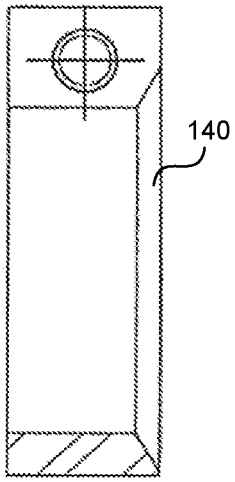
FIG. 8 is a cross-sectional view of the split collar taken along line 8-8 of FIG. 7.
Figure 9:
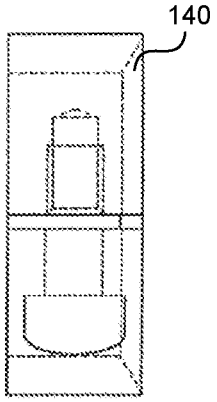
FIG. 9 is a top plan view of the split collar.

FIG. 6 is a front view of a split collar in accordance with one embodiment. FIG. 7 is a back view of the split collar, FIG. 8 is a cross-sectional view of the split collar taken along line 8-8 of FIG. 7. FIG. 9 is a top plan view of the split collar. The configuration of the split collar 160 can be selected based on the configuration of the receiver and barrel nut. The split collar 160 can have a one-piece or multi-piece construction and can be made, in whole or in part, of one or more metals or another rigid material.

Figure 10:
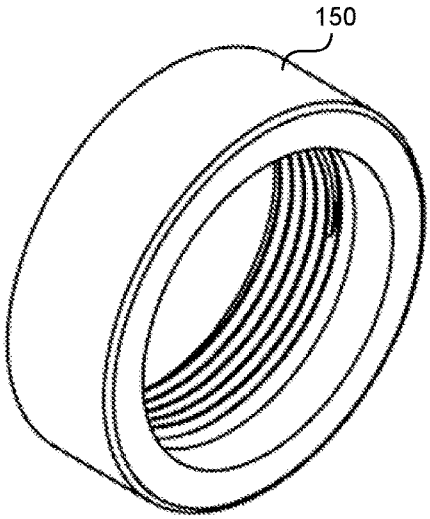
FIG. 10 is an isometric view of a barrel nut in accordance with one embodiment.
Figure 11:
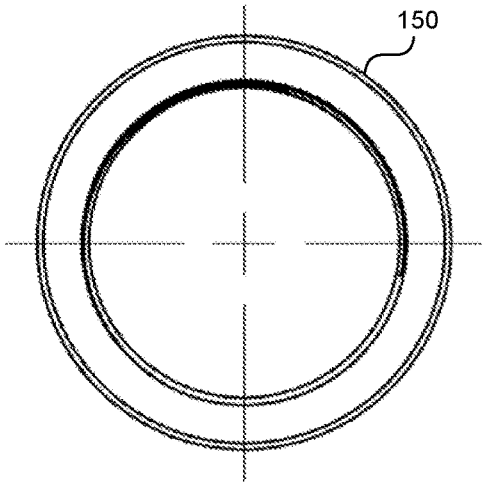
FIG. 11 is a back view of the barrel nut in accordance with one embodiment.
Figure 12:
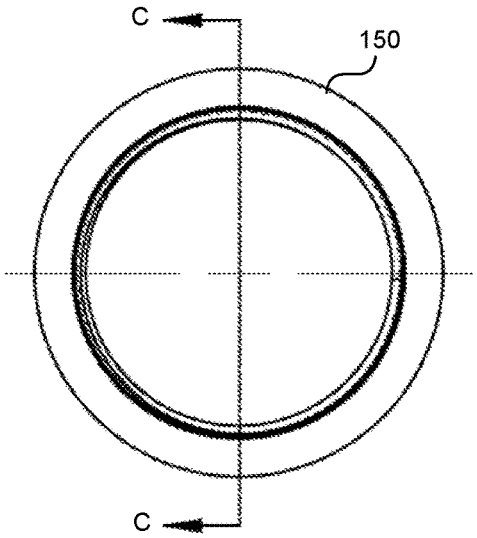
FIG. 12 is a front view of the barrel nut.
Figure 13:
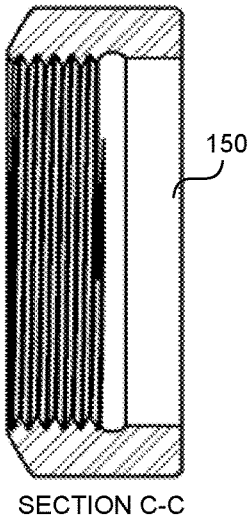
FIG. 13 is a cross-sectional view of the barrel nut taken along line 13-13 of FIG. 12.
Figure 14:
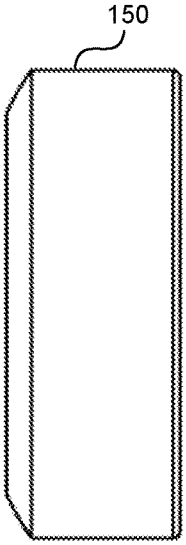
FIG. 14 is a top plan view of the barrel nut.

FIG. 10 is an isometric view of a barrel nut in accordance with one embodiment. FIG. 11 is a back view of the barrel nut in accordance with one embodiment, FIG. 12 is a front view of the barrel nut. FIG. 13 is a cross-sectional view of the barrel nut taken along line 13-13 of FIG. 12. FIG. 14 is a top plan view of the barrel nut. The configuration of the barrel nut 150 can be selected based on the configuration of the split collar and barrel.

Figure 15:
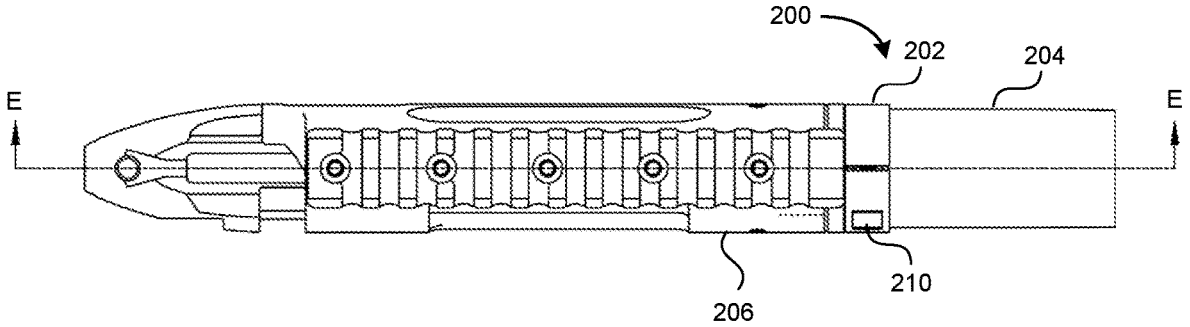
FIG. 15 is a top plan view of a portion of a firearm in accordance with another embodiment.
Figure 16:
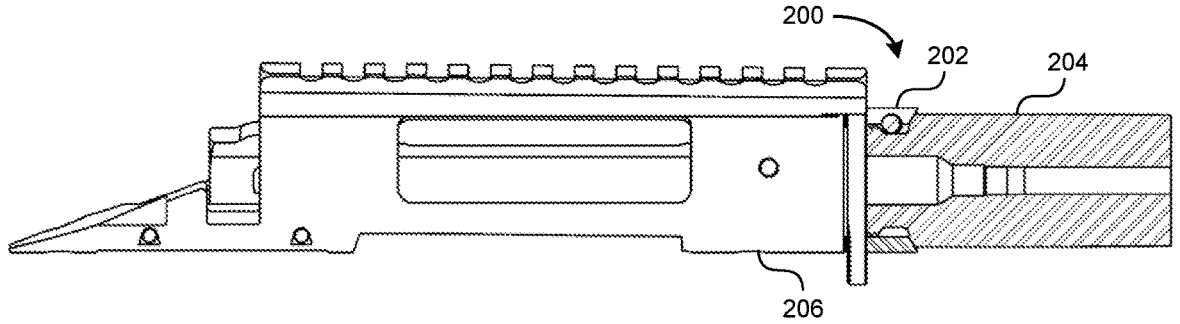
FIG. 16 is a partial cross-sectional view of the portion of the firearm taken along line 16-16 of FIG. 15.
Figure 17:
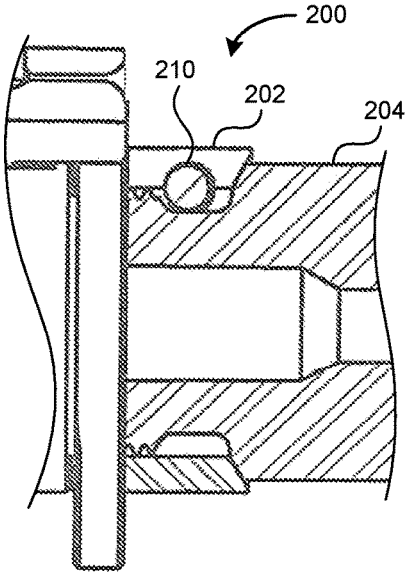
FIG. 17 is a detailed view of a portion of the firearm of FIG. 16.

FIG. 15 is a top view of a portion of a firearm in accordance with another embodiment. FIG. 16 is a cross-sectional view of the connection assembly 200 and barrel 204 of FIG. 15 taken along line 16-16. FIG. 17 is a detailed view of a portion of the firearm of FIG. 15. Referring to FIGS. 15-17, a connection assembly 200 can include a split collar 202 with a cone or angled surface that cooperates with an axisymmetric geometry of a barrel 204. In some embodiments, barrel 204 has a partially spherically shaped shoulder that bears against the cone of the split collar when the end of the barrel is positioned in a receiver 206. For example, a sloped surface of the split nut can bear against a sloped surface of the barrel 204. The connection assembly 200 can also include one or more fasteners 210 (e.g., screws) to open and close the split collar 202. In some embodiments, the fasteners 210 can be used to preload the threaded connection between the barrel 204 and receiver 206.

Figure 18:
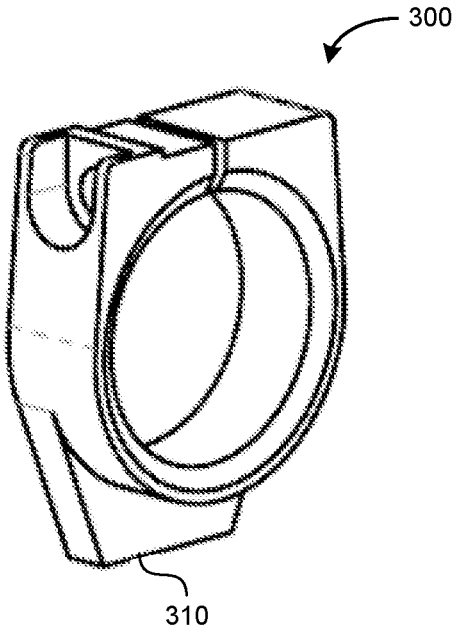
FIG. 18 is an isometric view of a split collar in accordance with another embodiment.
Figure 19:
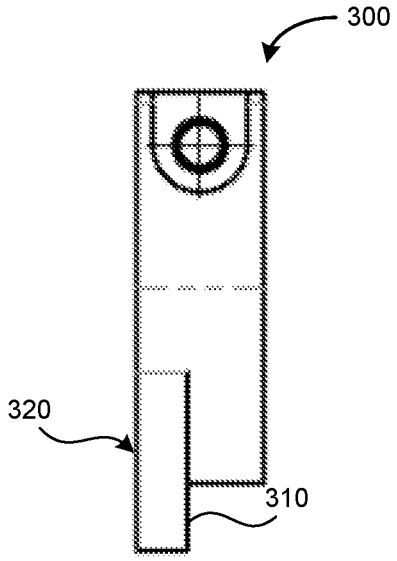
FIG. 19 is a side view of the split collar of FIG. 18.
Figure 20:
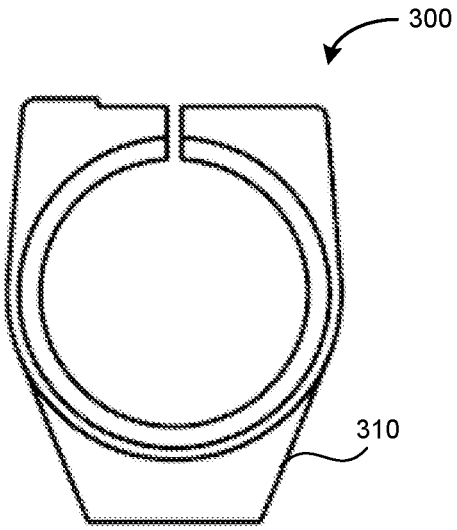
FIG. 20 is a front view of the split collar of FIG. 18.
Figure 21:
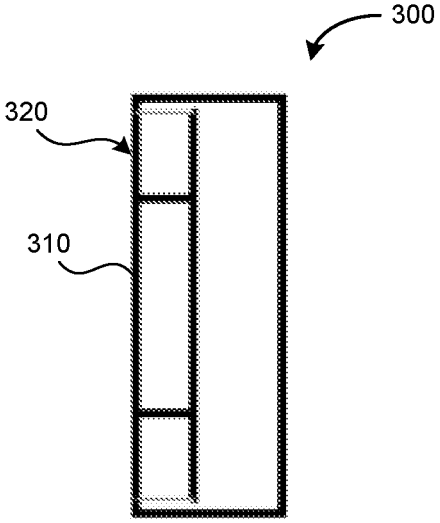
FIG. 21 is a bottom view of the split collar of FIG. 18.

FIG. 18 is an isometric view of a connection device or split collar 300 ("split collar 300") in accordance with another embodiment. FIG. 19 is a side view of the split collar 300. FIG. 20 is a front view of the split collar 300. FIG. 21 is a bottom view of the split collar 300. The split collar 300 can be configured to distribute forces applied to the firing mechanism, stock, barrels, or other features or components of the firearm. The body of the collar 300 can have a one-piece or multi-piece construction and can be made, in whole or in part, of one or more metals or another rigid material.

The split collar 300 can include an integrated protrusion or lug 310 ("lug 310") that can bear against the stock of the firearm in order to react the forces associated with, for example, recoil. The size, configuration, and position of the lug can be selected based on the expected recoil forces, characteristics (e.g., size, mechanical properties, etc.) of the stock, or the like. Referring to FIGS. 19 and 21, the spilt collar 300 includes a contact surface 320 that can physically contact the stock. The lug 310 can be a recoil lug that manages or limits the forces applied to connections, such as threads. For example, the split collar 300 can be used in the assembly discussed in connection with FIGS. 1 and 2 to manage forces applied the barrel threads 184 (FIG. 2).

The split collar 300 can be configured for use with different barrel nuts, barrels, and other components disclosed herein. Moreover, the split collar 300 can include features of the split rings discussed in connection with FIGS. 1-17. The split collars and connections discussed in connection with FIGS. 1-17, as well as other rings/collars/nuts disclosed herein, can also include lugs, integrated recoil lugs, or other features for managing forces between components and can be used with barrel nuts disclosed herein. Lugs can have shapes that are complementary to the shapes of the ends of the receiver, stocks, etc. The split collar 300 can maintain tensioning of the barrel and/or preloading (e.g., preloading of threaded connections) during a discharge and can also manage forces between connection points. For example, the lug 310 can contact the stock to prevent excessive forces from being applied to threads of a receiver due to axial forces associated by the barrel.

Figures 22, 23:
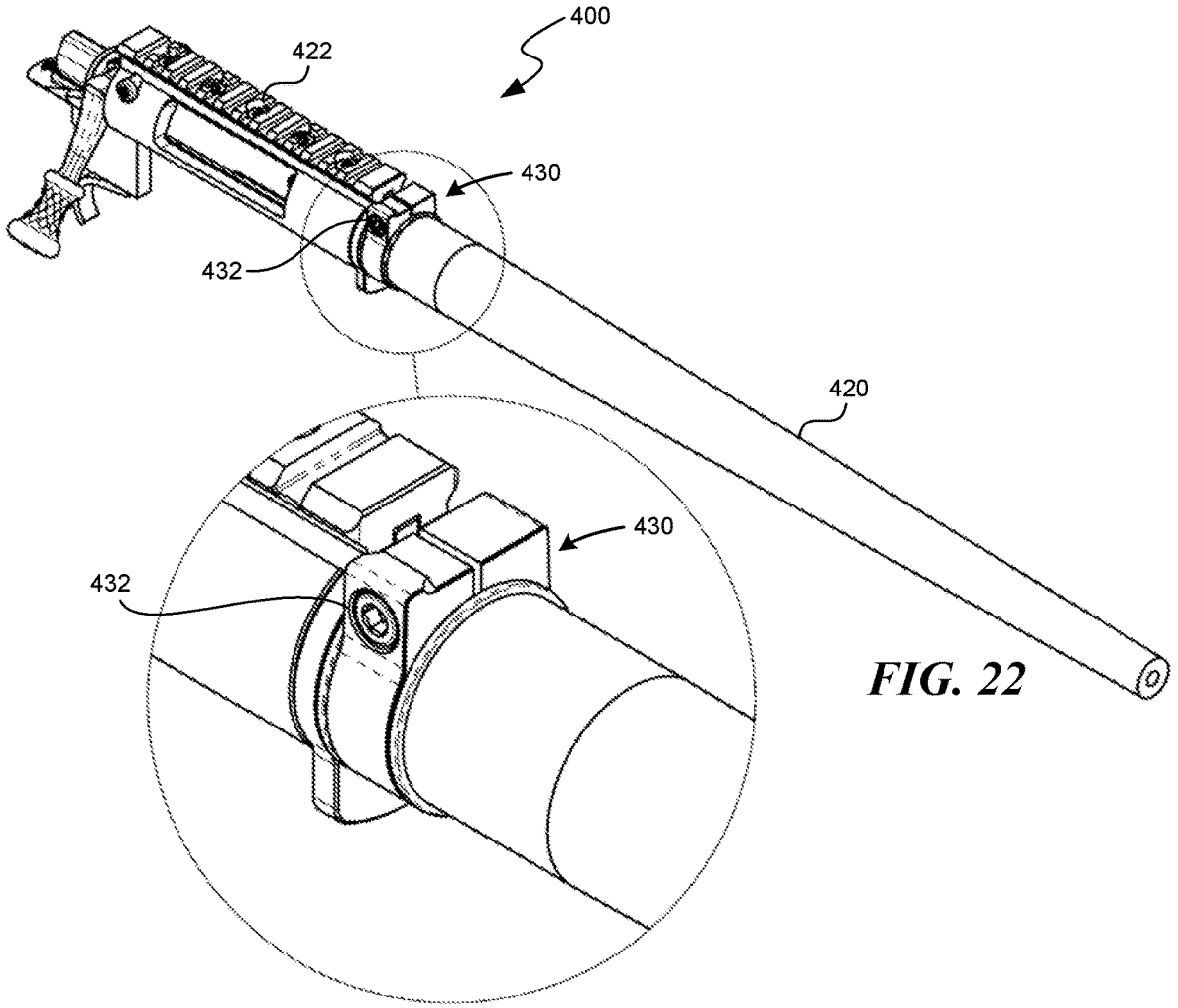
FIG. 22 is an isometric view of a portion of the firearm with a preloading device in accordance with one embodiment.
FIG. 23 is a detailed view of the preloading device of FIG. 22.

FIG. 22 is an isometric view of the portion of a firearm in accordance with one embodiment. FIG. 23 is a detailed isometric view of a preloading device of FIG. 22. The firearm assembly 400 can include a barrel 420, a bolt action 422, and a preloading device 430 therebetween. Referring now to FIG. 22, the preloading device 430 can include a threaded coupler 432 (FIG. 23) that can be rotated to increase or decrease the preloading force. The preloading device 430 can be controllably expanded and contracted to control preloading.

The preloading device 430 can be used to remove and install barrels using common tools, such as a hex key, a gage (e.g., a head space gage), etc. Once installed, the preloading device 430 can preload the receiver-barrel threaded connection and/or tension the barrel 420, thereby promoting long term receiver-barrel joint stability. For example, a pre-set torque applied to the clamping screw 432 can result in barrel thread-preloading requiring a significant amount of torque to loosen. The torque applied to the clamping screw 432 can be equal to or less than about 5%, about 10%, about 15%, about 20%, or about 30% of the torque need to loosen the barrel (e.g., torque needed to loosen the receiver-barrel threaded connection). In some embodiments, the torque applied to the clamping screw 432 can be about 90 $lb_f$-in (10 Nm) to achieve barrel thread preloading that requires about 100 $lb_f$-ft (136 Nm) of torque to loosen the receiver-barrel connection.

Figure 24:
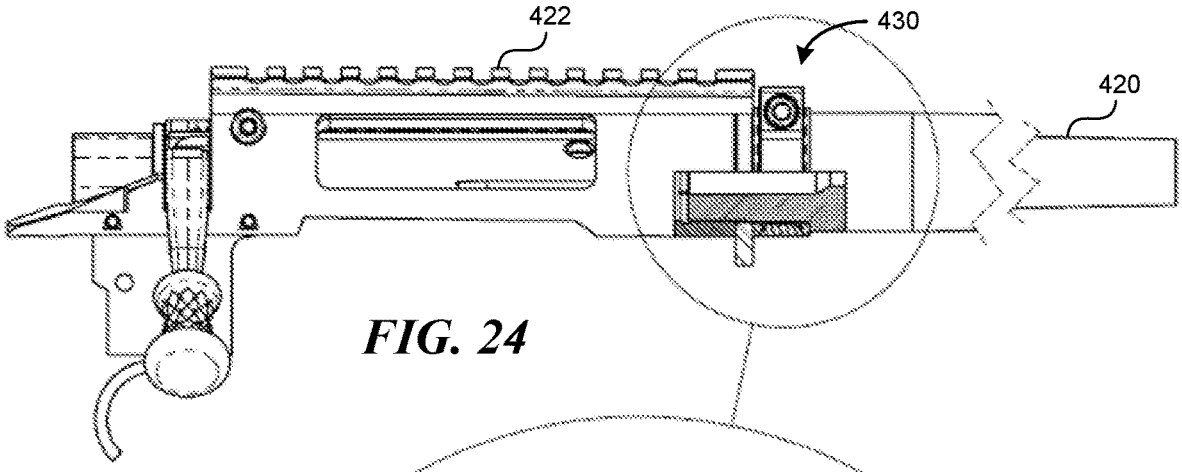
FIG. 24 is a partial cross-sectional view of a preloading device used between the barrel and recoil lug of a barreled-bolt-action.
Figure 25:
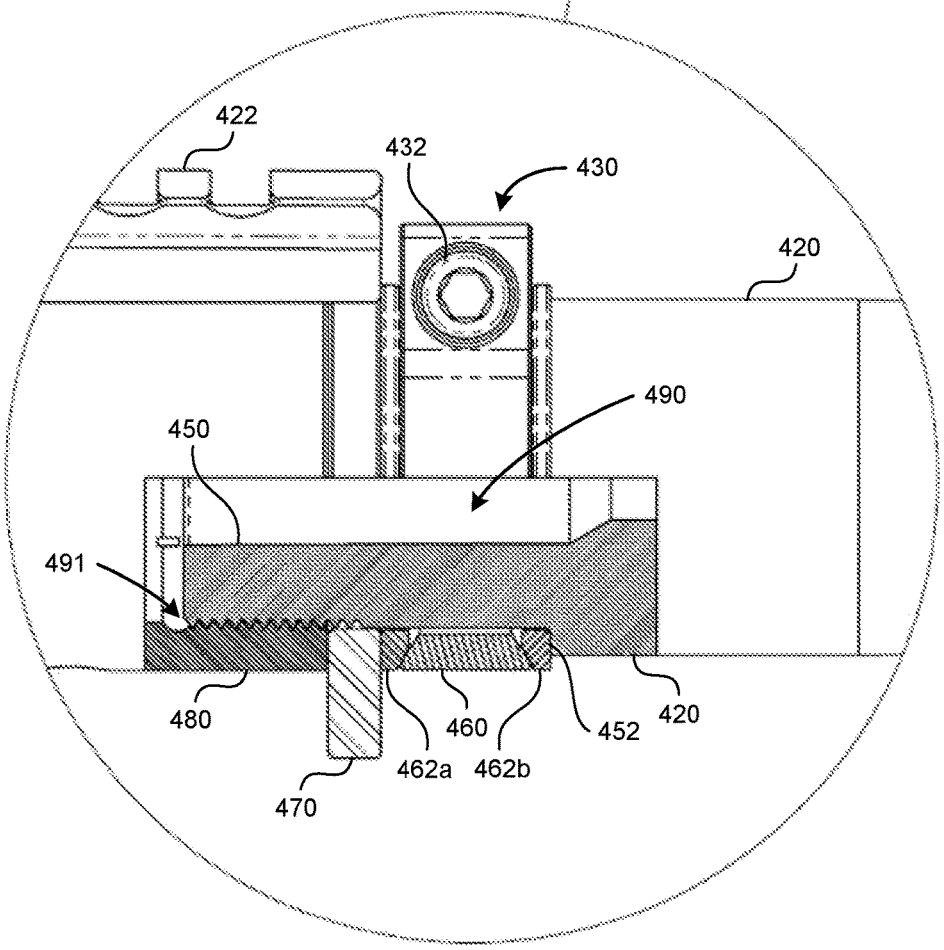
FIG. 25 is a detailed cross-sectional view of the preloading device of FIG. 24.

FIG. 24 is a partial cross-sectional view of a preloading device 430 and receiver-barrel connection. FIG. 25 is a detailed partial cross-sectional view of the preloading device 430. Referring now to FIG. 25, the barrel 420 can include a threaded end 450 and a barrel shoulder 452. The preloading device 430 can include a split collar 460 and a pair of thrust washers 462*a*, 462*b* (collectively "thrust washers 462"). The thrust washer 462*a* is positioned between a recoil lug 470 and the split collar 460. The thrust washer 462*b* is positioned between the split collar 460 and the barrel shoulder 452. The recoil lug 470 of the action 422 is positioned between a receiver 480 and the thrust washer 462*a*. The recoil lug 470 can be a separate component or integrated with the thrust washer 462*a* or integrated with a receiver 480.

The threaded coupler 432 can be used to alter (e.g., close or contract) the split collar 460 such that the split collar 460 drives the thrust washers 462 away from one another. For example, the split collar 460 can push the thrust washers 462*a*, 462*b* against the recoil lug 470, barrel shoulder 452, respectively, thereby tensioning a section 490 of the barrel 452. A threaded connection 491 is also preloaded. The threaded coupler 432 can be used to open or expand the split collar 460 to allow the thrust washers 462 to move toward one another, thus reducing or eliminating the preloading and/or barrel tensioning. This allows removal of the barrel 420 without requiring significant forces (e.g., torques).

Figure 26:
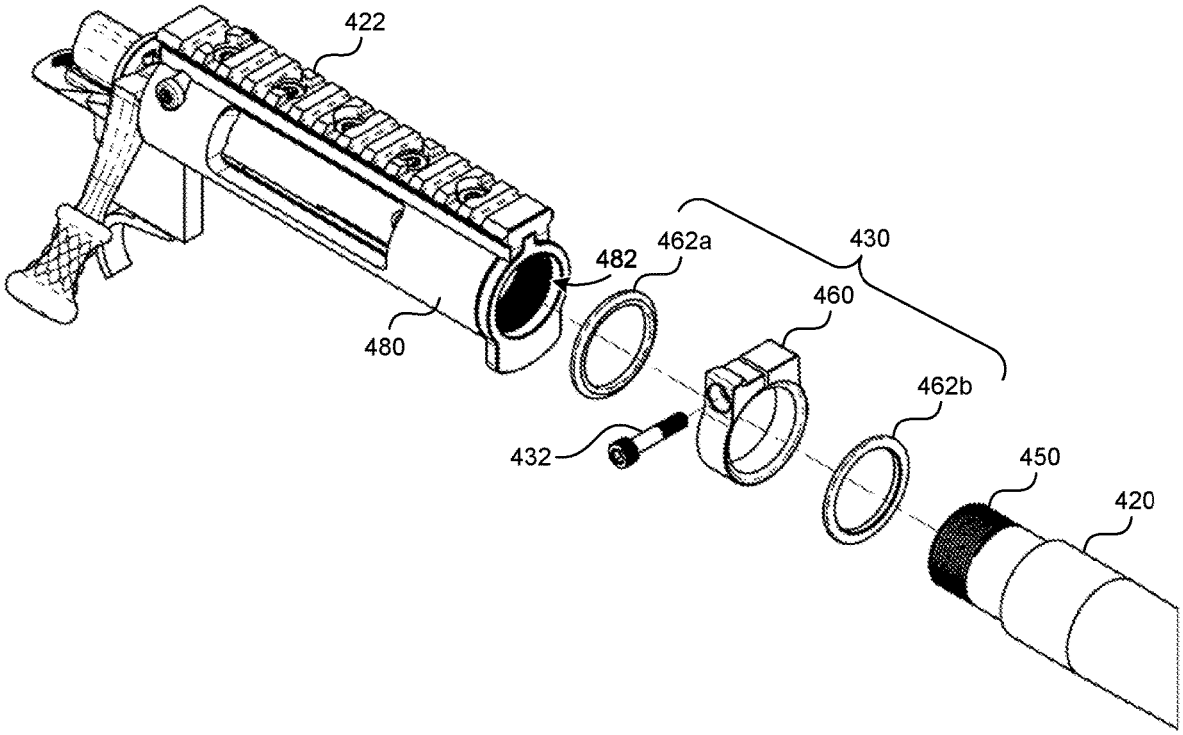
FIG. 26 is an exploded isometric view of the portion of the firearm of FIG. 22.

FIG. 26 is an exploded isometric view of the firearm assembly 400 of FIG. 22. To install the barrel 420, the threaded end 450 can be inserted through the thrust washer 462*b*, split collar 460, and thrust washer 462*a*. The threaded end 450 can be inserted into a bore 482 of the action 422 and then rotated to threadably connect to the receiver. In some installations, the barrel 420 can be hand-tightened by manually rotating the barrel 420 in a clockwise direction. Once hand-tightened, the preloading device 430 is expanded by rotating the threaded coupler 432. The amount of expansion can be selected based on the desired loading of the receiver-barrel threaded connection.

Figure 27:
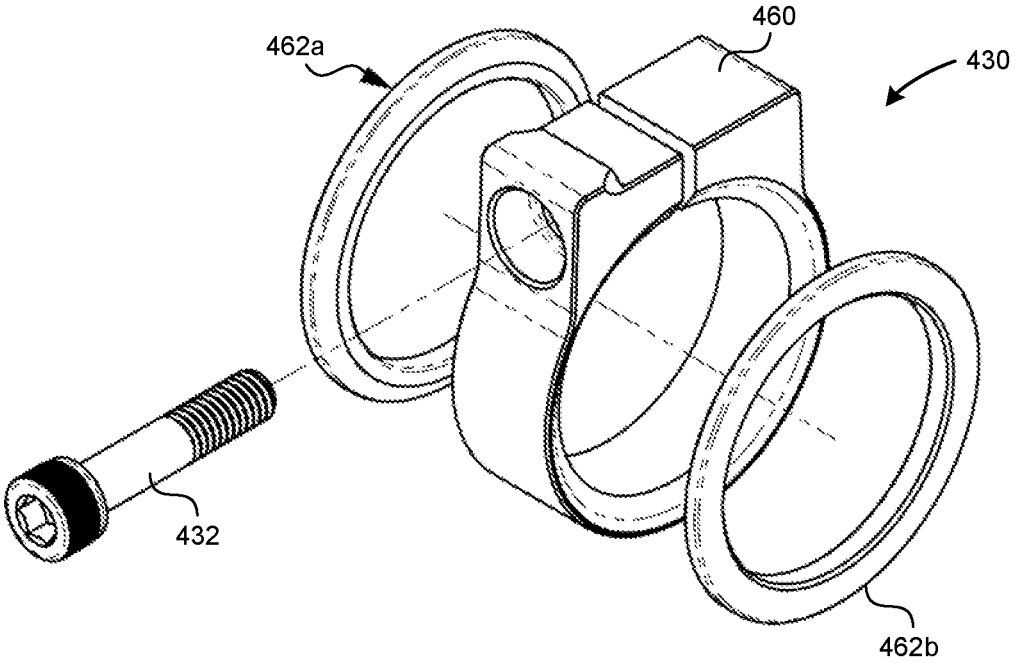
FIG. 27 is an exploded isometric view of a preloading device in accordance with one embodiment.
Figure 28:
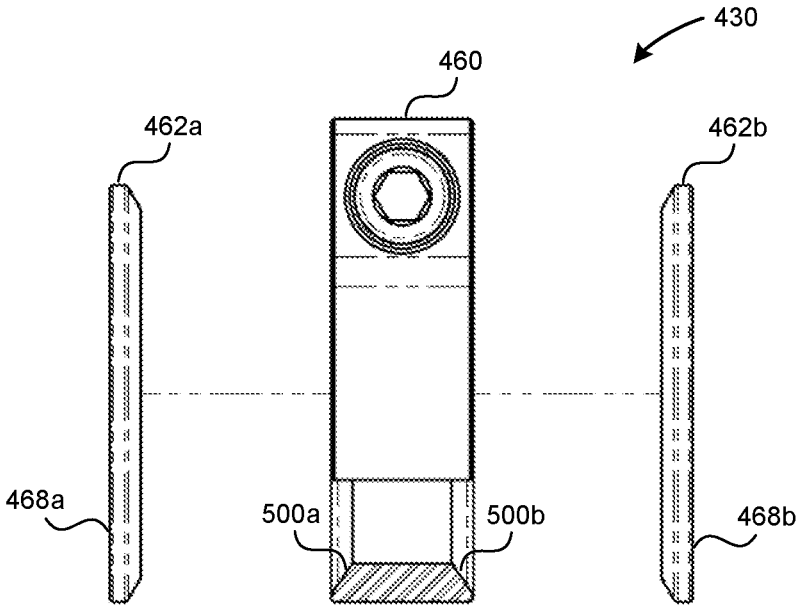
FIG. 28 is an exploded side view of the preloading device of FIG. 27.

FIG. 27 is an exploded isometric view of the preloading device 430 in accordance with one embodiment. FIG. 28 is an exploded partial cross-sectional side view of the preloading device 430 of FIG. 27. The split collar 460 (shown in partial cross section in FIG. 28) can include outwardly facing surfaces 500*a*, 500*b* for engaging thrust washers 462*a*, 462*b*, respectively. In some embodiments, the surfaces 500*a*, 500*b* can facilitate self-seating of the thrust washers 462*a*, 462*b*. Referring to FIG. 28, the thrust washer 462*a* has an outwardly facing receiver-contact surface 468*a*, and the thrust washer 462*b* has an outwardly facing barrel-contact surface 468*b*. The receiver-contact surface 468*a* and barrel-contact surface 468*b* can be generally flat surfaces. The split collar 460 and thrust washers 462 can be made, in whole or in part, of metal (e.g., steel, aluminum, etc.) or another rigid material, such as ceramics.

Figure 29:
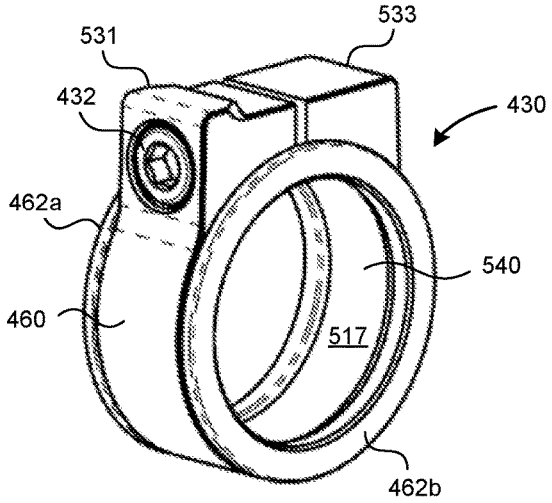
FIG. 29 is an isometric view of a preloading device in accordance with one embodiment.

FIG. 29 is an isometric view of the preloading device 430 in accordance with one embodiment. The threaded coupler 432 (illustrated as a clamping screw) can be configured to engage a small torqueing tool (e.g., a hex key), which applies a relatively small torque (e.g., 80 pound-inches, 100 pound-inches, 120 pound-inches, etc.) to tighten the preloading device 430. The configuration of the head of the threaded coupler 432 can be selected based on the configuration of the installation tools. For example, the head can be a hex head, a socket head, a slotted head, or the like. Tightening the clamp screw 432 can cause the toroidal and outward-facing surfaces of the split collar 460 to collapse upon the conical and inward facing surfaces of the thrust washers 462, thereby forcing apart the thrust washers 462. When the preloading device 430 is located between opposing surfaces of two components that are connected together, such as a rifle barrel and rifle receiver connected by a screw thread, the preloading device 430 can controllably force the barrel and receiver apart from one another, thus preloading the screw thread therebetween. Thus, by tightening the clamping screw 432, the connection between the barrel to the receiver can be effectively preloaded and stabilized.

Figure 30:
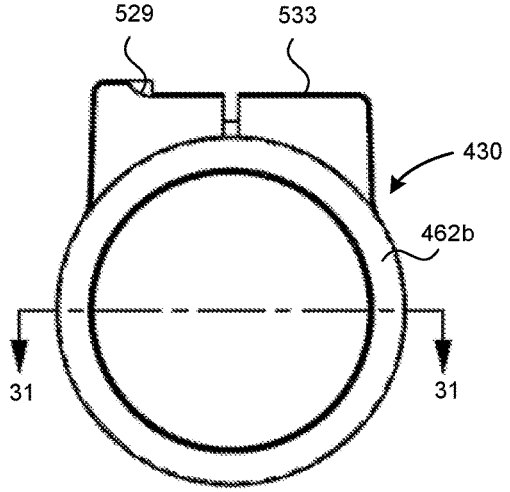
FIG. 30 is a front view of the preloading device of FIG. 29.

FIG. 30 is a front view of the preloading device 430. Referring to FIGS. 29 and 30, an annular body 540 of the split collar 460 can extend uninterrupted and continuously between the ends 529, 533 and defines a cylindrical inner surface 517 (FIG. 29). The body 540 can have a generally semi-circular shape. Other shapes are also possible, if needed or desired.

Figure 31:
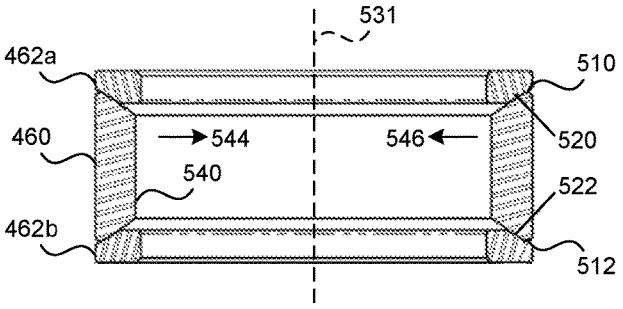
FIG. 31 is a cross-sectional view of the preloading device taken along line 31-31 of FIG. 30.

FIG. 31 is a cross-sectional view of the preloading device 430 taken along line 31-31 of FIG. 30. The split collar 460 can include outwardly facing surfaces 510, 512, which can be non-planar, substantially toroidal, substantially conical, sloped, or otherwise configured to slidably contact the thrust washers 462. The washers 426*a*, 462*b* can have washer surfaces 520, 522, respectively. As the annular body 540 is moved inwardly (indicated by arrows 544, 546), the surfaces 510, 512 can slide inwardly along the respective washer surfaces 520, 522, thereby pushing apart the thrust washers 426*a*, 462*b*.

One or both split collar surfaces 510, 512 can be non-planar surfaces, such as a curved surface (e.g., concave or convex), a partially spherical surface (e.g., a surface with a substantially spherical shape), a partially toroidal surface (e.g., a surface with a substantially toroidal surface), or the like. Each split collar surface 510, 512 can maintain contact with the respective washer 462 when the washer 462 is moved away from an aligned position. In one embodiment, the split collar surfaces 510, 512 are partially toroidal or conical surfaces and the washer surfaces 520, 522 are partially toroidal or conical surfaces. The slopes of the mated surfaces can generally match to provide for consistent contact when the split collar 460 is contracted or expanded. In some embodiments, the split collar surfaces 510, 512 can be substantially axisymmetric surfaces relative to axis 531. Suitable examples of axisymmetric surfaces include, but are not limited to, partially conical, toroidal, and spherical surfaces. The washer surfaces 520, 522 can also be substantially axisymmetric surfaces. In some embodiments, the thrust washer 462*a* can include substantially conical or toroidal surface 520, and the thrust washer 462*a* can include substantially conical or toroidal surface 522. The configurations of the non-planar surfaces 520, 522 can be selected based on the configuration of the corresponding non-planar surfaces 510, 512. The axisymmetric surfaces can be axisymmetric relative to the axis 531 defined by the firearm barrel preloading device 430 or another axis, such as a longitudinal axis of the barrel when in use.

Figure 32:
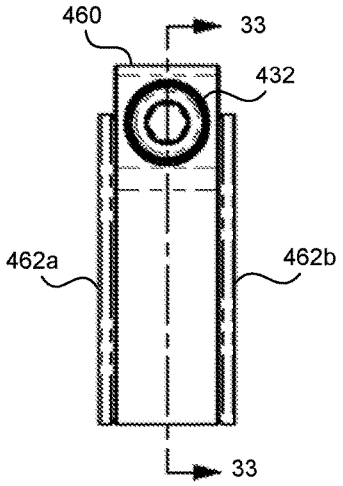
FIG. 32 is a side view of the preloading device of FIG. 29.
Figure 33:
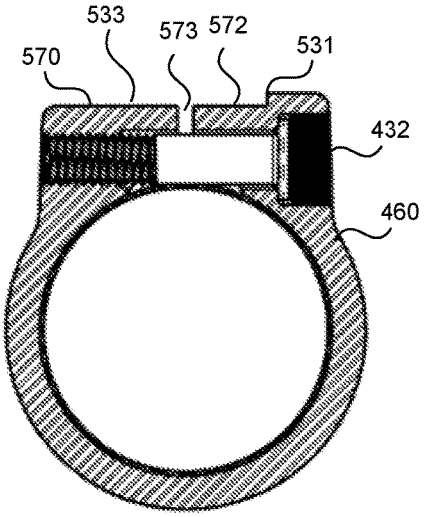
FIG. 33 is a cross-sectional view of the preloading device taken along line 33-33 of FIG. 32.

FIG. 32 is a side view of the preloading device 430. FIG. 33 is a cross-sectional view of the of the preloading device 430 taken along line 33-33 of FIG. 32. The screw 432 can extend through portions 570, 572 of the split collar 460. Referring now to FIG. 33, the end 533 has an internally threaded hole that receives the externally threaded end of the fastener 432. The fastener 432 can be rotated in one direction to move the ends 535, 533 toward one another (e.g., to collapse the split collar 460) and rotated in an opposite direction to move the ends 529, 533 away from one another (e.g., to open the split collar 460). A gap 573 can be reduced or closed by rotating the screw 432.

Figure 34:
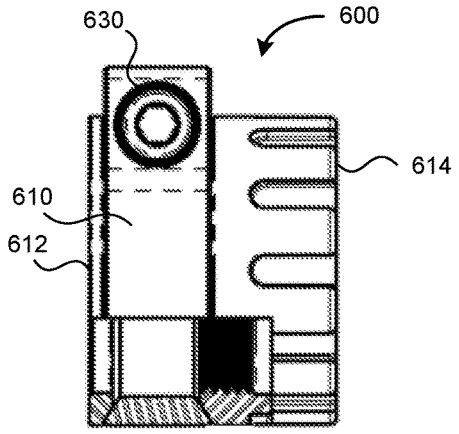
FIGS. 34 and 35 are a partial cross-sectional side view and an isometric view of a preloader device in accordance with an embodiment of the technology.
Figure 35:
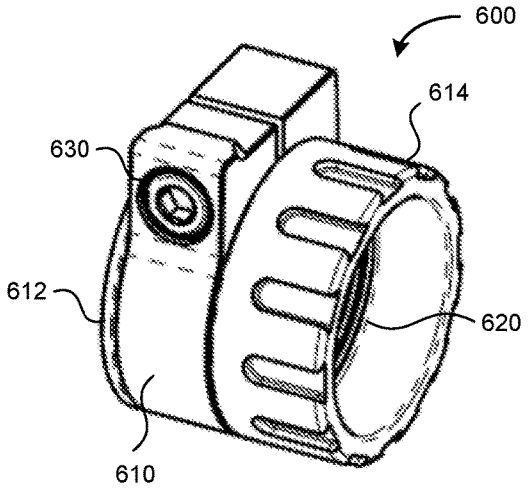

FIGS. 34-44 illustrate embodiments of preloader devices. The description of the tensioners, preloaders, and components of FIGS. 1-33 applies equally to the embodiments of FIGS. 34-44 unless indicated otherwise. FIGS. 34 and 35 are a partial cross-sectional view and an isometric view of a preloader device 600 in accordance with an embodiment of the technology. The preloader device 600 can include a split collar 610, a thrust washer 612, and a barrel nut 614. One or both of the thrust washer 612 and barrel nut 614 can have inwardly-facing (e.g., facing toward the split collar 610) axisymmetric surfaces, non-planar surfaces, or other types of bearing surfaces. The barrel nut 614 has an internally threaded region 620 for threadably engaging the barrel. The barrel nut 614 can be rotated to load the threaded connection between the barrel and the receiver. The split collar 610 can then be operated to further increase the applied forces. The barrel nut 614 and screw 630 can be independently operated to adjust the preloading force.

Figure 36:
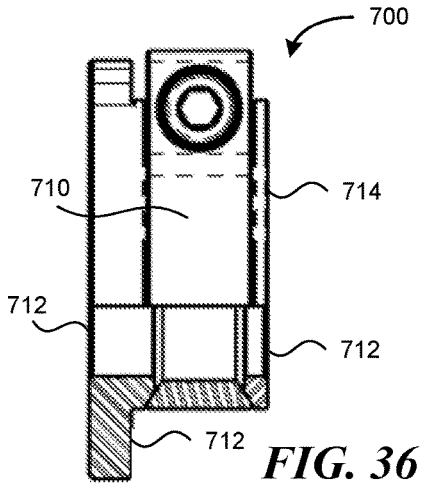
FIGS. 36 and 37 are a partial cross-sectional side view and an isometric view of a preloader device in accordance with another embodiment of the technology.
Figure 37:
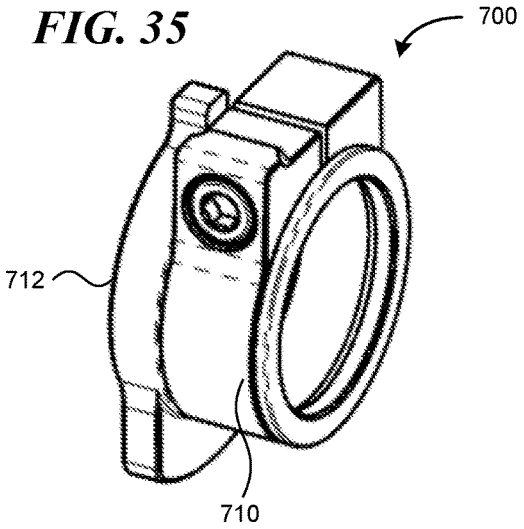

FIGS. 36 and 37 are a partial cross-sectional view and an isometric view of a preloader device 700 in accordance with an embodiment of the technology. The preloader device 700 includes a split collar 710, an integrated recoil lug 712, and a thrust washer 714. One or both of the recoil lug 712 and thrust washer 714 can have inwardly-facing non-planar surfaces, such as axisymmetric surfaces.

Figure 38:
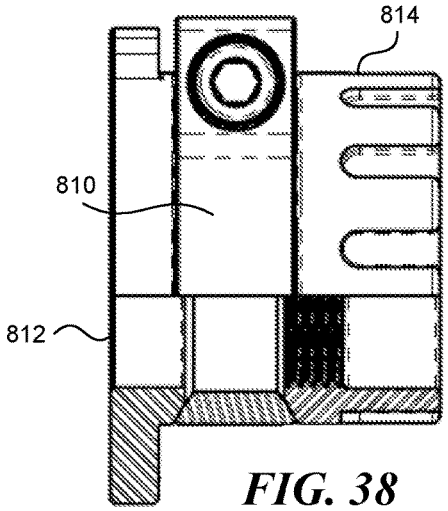
FIGS. 38 and 39 are a partial cross-sectional side view and an isometric view of a preloader device in accordance with yet another embodiment of the technology.
Figure 39:
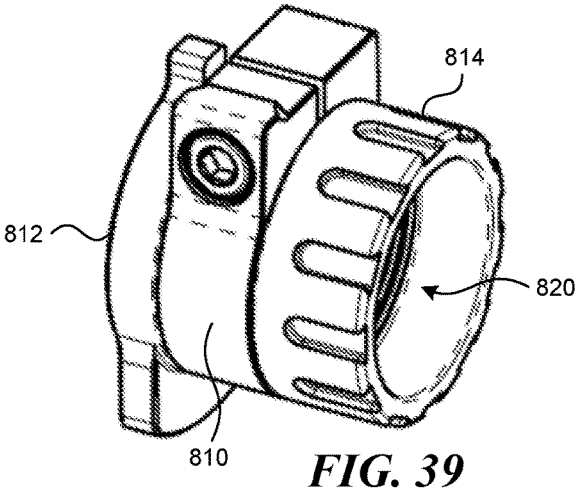

FIGS. 38 and 39 are a partial cross-sectional view and an isometric view of a preloader device 800 in accordance with an embodiment of the technology. The preloader device 800 can include a split collar 810, an integrated recoil lug 812, and a barrel nut 814. One or both of the recoil lug 812 and barrel nut 814 can have inwardly-facing axisymmetric and/or non-planar surfaces. The barrel nut 814 can have an internally threaded region 820 for threadably engaging a threaded barrel end. The barrel nut 814 can be rotated to preload the threaded connection between the barrel and the receiver. The split collar 810 can then be operated to further increase the preloading.

Figure 40:
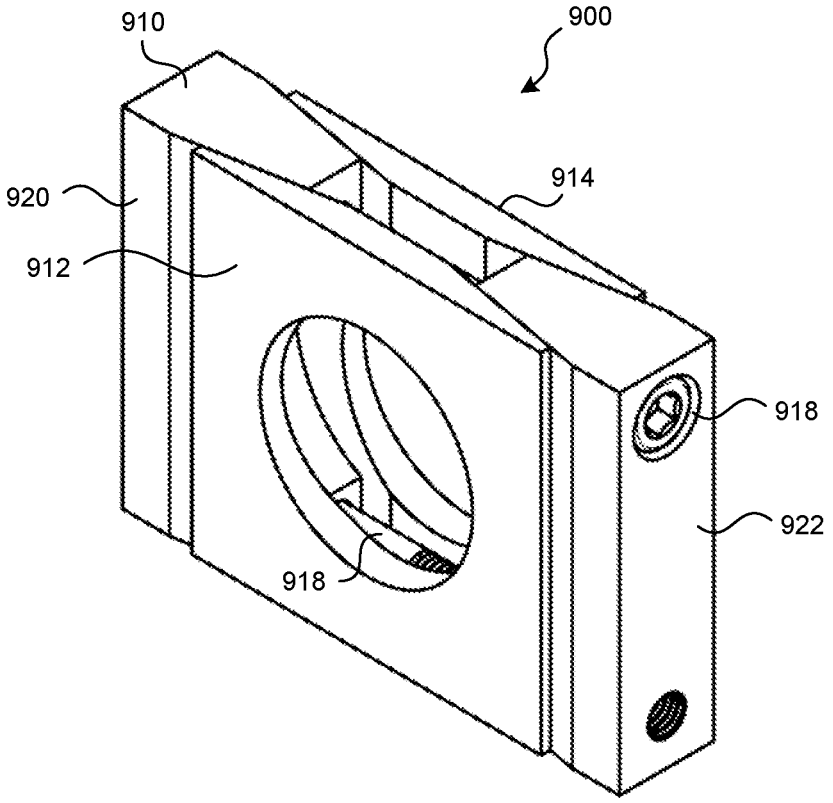
FIG. 40 is an isometric view of a preloader device in accordance with another embodiment.

FIG. 40 is an isometric view of a pre-loader device 900 in accordance with another embodiment. The preloader device 900 can include a deployable drive assembly 910 ("drive assembly 910"), a barrel-contact element 912, and a receiver-contact element 914. The drive assembly 910 can include one or more drive elements or screws 918 ("screws 918") and spreaders 920, 922, which can be translated toward one another to push apart the barrel-contact element 912 and receiver-contact element 914.

Figure 41:
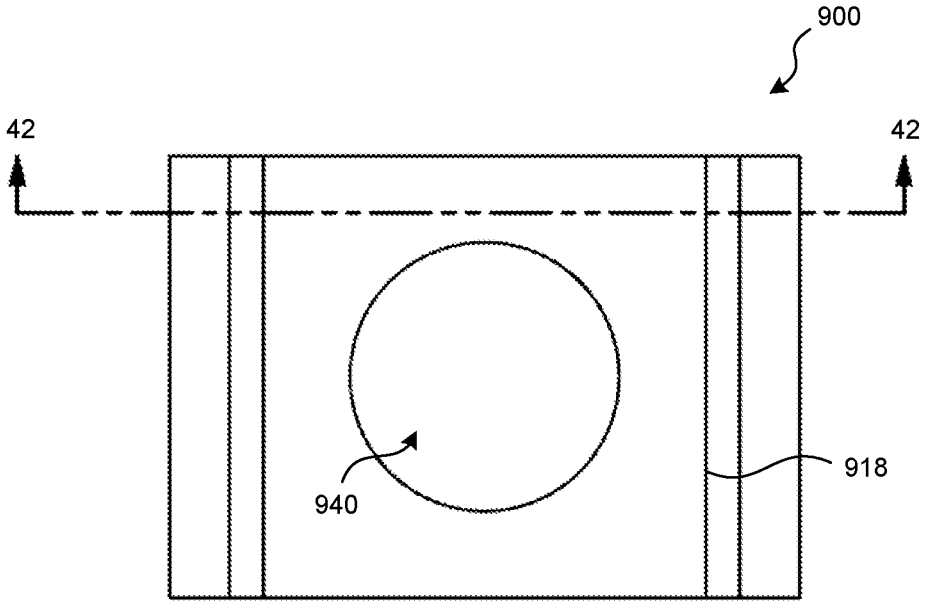
FIG. 41 is a front view of the pre-loader device of FIG. 40.

FIG. 41 is a front view of the preloader device 900 of FIG. 40. The preloader device 900 can define a barrel-receiving bore 940. The preloader device 900 can have a generally rectangular profile (illustrated), square profile, circular, or oval profile, as viewed from the front. The heads of the screws 918 are accessible at the sides of the preloader device 900.

Figure 42:
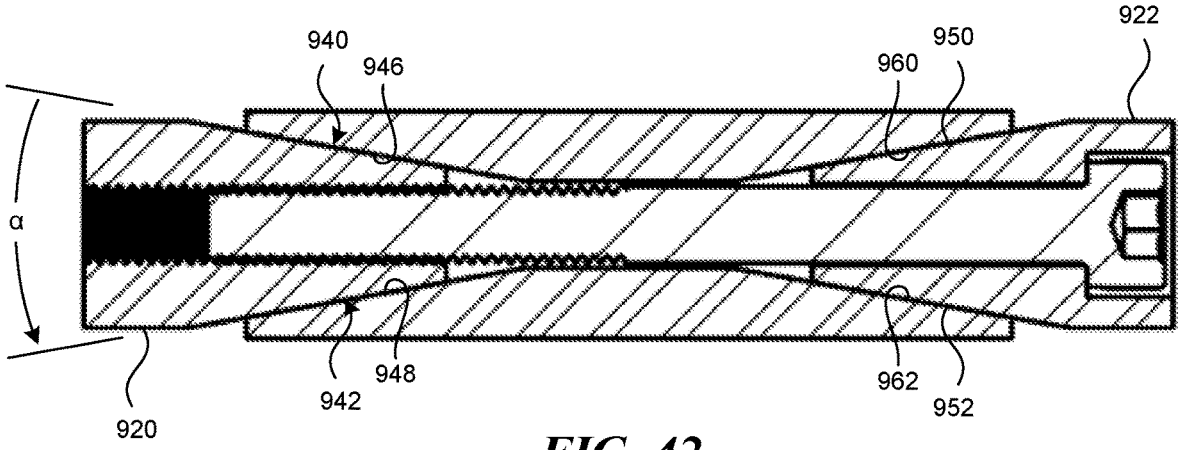
FIG. 42 is a cross-sectional view of the preloaded device taken along line 42-42 of FIG. 41.

FIG. 42 is a cross-sectional view of the preloaded device 900 taken along line 42-42 of FIG. 41. Each spreader 920, 922 can be generally wedge-shaped with sloped surfaces. For example, the spreader 920 has opposing sloped surfaces 940, 942 defining an angle $\alpha$ of about 10 degrees, about 20 degrees, about 25 degrees, about 30 degrees, about 35 degrees, about 40 degrees, or another suitable angle, and the surfaces 940, 942 can slidably contact the element surfaces 946, 948. The spreader 922 can have opposing sloped surfaces 950, 952 for slidably contacting element surfaces 960, 962. The slope of the surfaces 950, 952 can be equal to the slope of the surfaces 940, 942, and the surfaces 940, 942, 950, 952 can be planar surfaces, curved surfaces, or the like.

The fasteners 918 can be positioned between, as viewed from above, central regions of the elements 912, 914, as well as at other suitable locations. The illustrated embodiment of the preloaded device 900 includes two fasteners 918. There can be additional fasteners located at various locations to provide the desired movement and/or locking forces.

Figure 43:
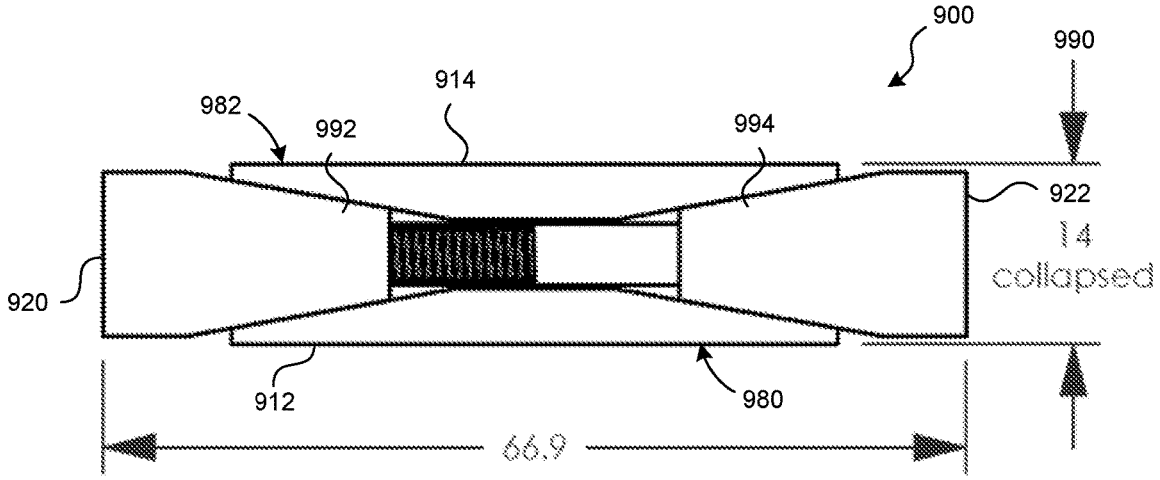
FIG. 43 is a top plan view of the preloaded device in a collapsed configuration.
Figure 44:
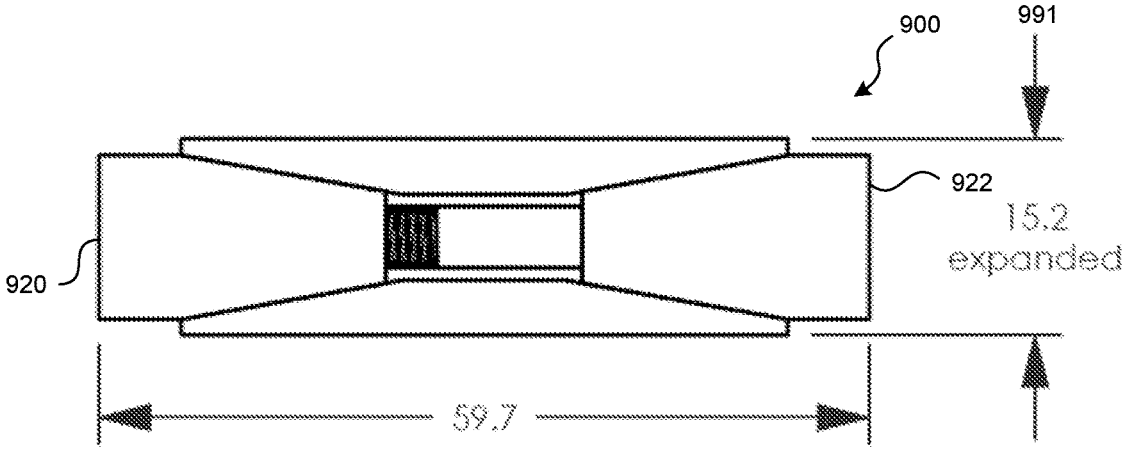
FIG. 44 is a top plan view of the preloaded device in an expanded configuration.

FIG. 43 is a top plan view of the preloader device 900 in a partially collapsed configuration. FIG. 44 is a top plan view of the preloader device 900 in an expanded configuration. A distance 990 (FIG. 43) between a barrel-contact surface 980 of the barrel-contact element 912 and a receiver-contact surface 982 of the receiver-contact element 914 can be shorter than an expanded distance 991 (FIG. 44). The ratio of the collapsed distance 990 to the expanded distance 991 can be equal to or greater than about 07, about 0.75, about 0.8, about 0.85, about 0.9, about 0.925, about 0.95, about 0.975, or about 0.98, for example. The amount of spreader movement can be selected based on the amount of expansion.

To install a barrel, a threaded end of the barrel can be inserted into the bore 940. The receiver-contact element 914 can be positioned against a front face of a receiver. After the barrel is hand tightened, the fasteners 918 can be simultaneously or sequentially rotated to draw the spreaders 920, 922 towards one another. As the spreaders 920, 922 to move inwardly toward one another, the tapered ends 992, 994 (FIG. 43) of the respective spreader 920, 922 can drive apart the elements 912, 914. For example, the spreaders 920, 922 can translate inward toward a vertical plane passing through the longitudinal axis of the barrel in order to push the barrel-contact element 912 and receiver-contact element 914 away from one another and in directions that are substantially parallel to the longitudinal axis. The torque applied to each of the clamping screws 918 can be about 90 $lb_f$-in (10 Nm) to achieve barrel thread preloading that requires about 100 $lb_f$-ft (136 Nm) of torque to loosen the receiver-barrel connection. Other torques (8 Nm, 9 Nm, 10 Nm, 11 Nm, 12 Nm, etc.) can be applied for other amounts of preloading.

CONCLUSION

The embodiments, features, connectors, tensioners, connection assemblies, methods and techniques described herein may, in some embodiments, be similar to and/or include any one or more of the embodiments, features, firing components, systems, devices, materials, methods and techniques described in U.S. Pat. Nos. 7,743,543; 8,572,885; application Ser. Nos. 13/771,021, 15/193,483, and U.S. Provisional Patent Application No. 61/600,477; and U.S. Provisional Patent Application No. 61/602,520. U.S. Pat. No. 7,743,543, U.S. patent application Ser. No. 13/771,021, U.S. Provisional Patent Application No. 61/600,477; and U.S. Provisional Patent Application No. 61/602,520 are incorporated herein by reference in their entireties. In addition, the embodiments, features, systems, devices, materials, methods and techniques described herein may, in certain embodiments, be applied to or used in connection with any one or more of the embodiments, firearms, features, systems, devices, materials, methods and techniques disclosed in the above-mentioned U.S. Pat. Nos. 7,743,543; 8,572,885; application Ser. No. 13/771,021, application Ser. No. 15/193,483; U.S. Provisional Patent Application No. 61/600,477; U.S. patent application Ser. No. 13/771,021, U.S. Provisional Patent Application No. 61/600,477; and U.S. Provisional Patent Application No. 61/602,520. The connection assemblies and other features disclosed herein can be incorporated into a wide range of different firearms (e.g., rifles, pistols, or other firearms) and actions.

The description of one connection or preloading device can apply to other embodiments. For example, the description of the preloading device 430 applies equally to, for example, the devices 130, 200, 600, 700, 800, 900, unless indicated otherwise. The mated surfaces disclosed herein can be substantially conical, substantially parabolic, substantially elliptical, or other curved shape suitable for contacting one another. For example, washer or nut surfaces can be partially spherical surfaces, partially elliptical surfaces, or partially parabolic surfaces. In such embodiments, the split collar surfaces can be partially spherical, partially toroidal, etc. In some embodiments, forward and/or rearward washer surfaces of the split collar can be partially spherical and can engage parabolic or elliptical split collar surfaces. The configurations of the bearing surfaces can be selected to maintain contact irrespective of the angular position of the washers. The dimensions, configuration, and curvature of surfaces can be selected based on the desire interaction between components. The embodiments can have different types of collapsible components (e.g., split nuts, split collars, etc.) for forcing apart components. The configuration of collapsible components can be selected based on the configuration and functionality of other components. The collapsible components can also have integrated features, such as fasteners, lugs, or the like. It should be noted that, as used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

From the foregoing, it will be appreciated that specific embodiments of the invention have been described herein for purposes of illustration, but that various modifications may be made without deviating from the scope of the invention. Accordingly, the invention is not limited except as by the appended claims.

What is claimed is:

1. A firearm barrel preloading device, comprising:
an outwardly facing barrel-contact surface;
an outwardly facing receiver-contact surface; and
a plurality of surfaces between the barrel-contact surface and the receiver-contact surface, the surfaces cooperate to spread apart the barrel-contact surface and the receiver-contact surface to preload a barrel-receiver connection, wherein pairs of the surfaces slidably contact one another and have complementary configurations, and wherein the surfaces are non-planar axisymmetric surfaces or sloped surfaces.

2. The preloading device of claim 1, wherein the surfaces are axisymmetric surfaces that axisymmetric relative to a longitudinal axis of the firearm barrel preloading device and include one or more partially spherical surfaces and/or partially conical surfaces.

3. A firearm barrel preloading device, comprising
an outwardly facing barrel-contact surface;
an outwardly facing receiver-contact surface;
a plurality of surfaces between the barrel-contact surface and the receiver-contact surface, the surfaces cooperate to spread apart the barrel-contact surface and the receiver-contact surface to preload a barrel-receiver connection, and wherein the surfaces are non-planar axisymmetric surfaces or sloped surfaces;
a first interface element with the barrel-contact surface;
a second interface element with the receiver-contact surface; and
a split collar with a wedged-shaped arcuate body positionable between the first and second interface elements, and wedge-shaped arcuate body spreads apart the first and second interface elements when the split collar is at least partially collapsed.

4. The preloading device of claim 3, wherein at least one of the first interface element and the second interface element is a recoil lug or a washer.

5. The preloading device of claim 3, wherein the axisymmetric surfaces slidably contact the first and second interface elements to maintain (a) face-to-face contact between the barrel-contact surface and a face of a shoulder of a barrel and (b) face-to-face contact between the receiver-contact surface and a face of a receiver.

6. The preloading device of claim 3, wherein the preloading device imparts preloading forces in a direction substantially parallel to a longitudinal axis of a barrel without damaging to either the barrel or receiver.

7. The preloading device of claim 1, wherein the preloading device expands without clamping onto the receiver and/or barrel.

8. The preloading device of claim 1, wherein each of the barrel-contact surface, the receiver-contact surface, and the surfaces surrounds the barrel, and the preloading device preloads the barrel-receiver connection without being mechanically connected to the receiver.

9. A firearm barrel preloading device, comprising:

an outwardly facing barrel-contact surface;

an outwardly facing receiver-contact surface;

a plurality of surfaces between the barrel-contact surface and the receiver-contact surface, the surfaces cooperate to spread apart the barrel-contact surface and the receiver-contact surface to preload a barrel-receiver connection, and wherein the surfaces are non-planar axisymmetric surfaces or sloped surfaces;

a barrel washer including the barrel-contact surface and an axisymmetric barrel washer surface;

a receiver washer including the receiver-contact surface and an axisymmetric receiver washer surface; and a split collar including a first axisymmetric surface and a second axisymmetric surface, the first axisymmetric surface slidably contacts the axisymmetric barrel washer surface, and the second axisymmetric surface slidably contacts the receiver washer surface.

10. A firearm barrel preloading device, comprising:

an outwardly facing barrel-contact surface;

an outwardly facing receiver-contact surface;

a plurality of surfaces between the barrel-contact surface and the receiver-contact surface, the surfaces cooperate to spread apart the barrel-contact surface and the receiver-contact surface to preload a barrel-receiver connection, and wherein the surfaces are non-planar axisymmetric surfaces or sloped surfaces; and a split collar that contracts radially inward towards a longitudinal axis of the preloading device to drive apart the barrel-contact surface and the receiver-contact surface.

11. The preloading device of claim 1, wherein the preloading device is movable between an installation configuration for allowing a barrel to be installed in an action and an expanded loading configuration for pushing apart the barrel-contact surface and the receiver-contact surface.

12. The preloading device of claim 1, wherein the preloading device is configured to gradually expand along a longitudinal axis of the preloading device.

13. A firearm barrel preloading device, comprising:

a barrel-contact surface;

a receiver-contact surface; and a plurality of non-planar axisymmetric or sloped surfaces located between the barrel-contact surface and the receiver-contact surface, wherein pairs of the surfaces slidably contact one another to drive apart the barrel-contact surface and the receiver-contact surface to preload a barrel-receiver connection when the barrel-contact surface contacts a barrel surface and the receiver-contact surface contacts a receiver.

14. The firearm barrel preloading device of claim 13, further comprising a split collar that contracts radially inward towards a long axis of the firearm barrel preloading device to drive apart the barrel-contact surface and the receiver-contact surface.

* * * * *